US006929536B2

(12) United States Patent
Kuhn et al.

(10) Patent No.: US 6,929,536 B2
(45) Date of Patent: Aug. 16, 2005

(54) SYSTEM FOR CHEMICAL MECHANICAL POLISHING COMPRISING AN IMPROVED PAD CONDITIONER

(75) Inventors: Matthias Kuhn, Dresden (DE); Stefan Lingel, Dresden (DE)

(73) Assignee: Advanced Micro Devices, Inc., Austin, TX (US)

( * ) Notice: Subject to any disclaimer, the term of this patent is extended or adjusted under 35 U.S.C. 154(b) by 0 days.

(21) Appl. No.: 10/609,096

(22) Filed: Jun. 27, 2003

(65) Prior Publication Data

US 2004/0132388 A1 Jul. 8, 2004

(30) Foreign Application Priority Data

Dec. 31, 2002 (DE) ..... 102 61 465

(51) Int. Cl.[7] ..... B24B 1/00

(52) U.S. Cl. ..... 451/56; 451/21; 451/445; 451/444; 451/72; 451/443

(58) Field of Search ..... 451/56, 444, 21, 451/443, 445, 72; 438/692–693

(56) References Cited

U.S. PATENT DOCUMENTS 5,154,021 A * 10/1992 Bombardier et al. ..... 451/444
5,716,264 A * 2/1998 Kimura et al. ..... 451/443
5,782,675 A * 7/1998 Southwick ..... 451/56
5,782,799 A * 7/1998 Jacobsen et al. ..... 604/500
5,902,173 A * 5/1999 Tanaka ..... 451/56
5,957,757 A 9/1999 Berman
6,168,502 B1 * 1/2001 Allman et al. ..... 451/38
6,258,166 B1 * 7/2001 Leon et al. ..... 118/324
6,306,012 B1 * 10/2001 Sabde ..... 451/41
6,443,816 B2 * 9/2002 Inoue et al. ..... 451/56
6,579,799 B2 * 6/2003 Chopra et al. ..... 438/692
6,764,389 B1 * 7/2004 Butterfield et al. ..... 451/56
6,769,968 B2 * 8/2004 So ..... 451/56
6,773,332 B2 * 8/2004 Moore ..... 451/5

FOREIGN PATENT DOCUMENTS

GB 2 360 725 A 10/2001
WO WO 99/50024 10/1999

* cited by examiner

*Primary Examiner*—George Nguyen
(74) *Attorney, Agent, or Firm*—Williams, Morgan & Amerson

(57) ABSTRACT

A system and method for chemical mechanical polishing of a substrate is disclosed in which a polishing pad is conditioned by directing a fluid jet to the surface of the polishing pad. Thus, the use of expensive consumables, like conditioning pads comprising diamonds, can be avoided. Furthermore, the risk of substrates being scratched by diamonds lost from the conditioning pad is avoided.

42 Claims, 5 Drawing Sheets

SYSTEM FOR CHEMICAL MECHANICAL POLISHING COMPRISING AN IMPROVED PAD CONDITIONER

BACKGROUND OF THE INVENTION

1. Field of the Invention

The present invention relates to the field of fabrication of microstructures, and, more particularly, to a tool for conditioning the surface of a polishing pad in a system for chemical mechanical polishing of substrates.

2. Description of the Related Art

In microstructures such as integrated circuits, a large number of elements, e.g., transistors, capacitors and resistors, are fabricated on a single substrate by depositing semi-conductive, conductive and insulating material layers and patterning those layers by photolithography and etch techniques. The individual circuit elements are electrically connected by means of metal lines. In the formation of these metal lines, a so-called inter-layer dielectric is deposited and vias and trenches are thereafter formed in this dielectric layer. The vias and trenches are then filled with a metal, e.g., copper, to provide electrical contact between the circuit elements. In modem integrated circuits, a plurality of such metallization layers comprising metal lines must be stacked on top of each other to maintain the required functionality. The repeated patterning of material layers, however, creates a non-planar surface topography, which may deteriorate subsequent patterning processes, especially for such microstructures including features with minimum dimensions in the submicron range, as is the case for sophisticated integrated circuits.

It has turned out to be necessary to planarize the surface of the substrate between the formation of subsequent layers. A planar surface of the substrate is desirable for various reasons, one of them being the limited optical depth of the focus in photolithography which is used to pattern the material layers of microstructures. Chemical mechanical polishing is an appropriate and widely used process to achieve global planarization of a substrate.

FIG. 1 schematically shows a schematic sketch of a conventional system 100 for chemical mechanical polishing. The system 100 comprises a platen 101 on which a polishing pad 102 is mounted. Frequently, polishing pads are formed of a cellular microstructure polymer material having numerous voids, such as polyurethane. A polishing head 130 comprises a body 104 and a substrate holder 105 for receiving and holding a substrate 103. The polishing head 130 is coupled to a drive assembly 106. The device 100 further comprises a slurry supply 112 and a pad conditioner 131. The pad conditioner 131 comprises a conditioning head 107 and a conditioning pad 108 attached to the conditioning head 107. The conditioning head 107 is coupled to a drive assembly 109.

In operation, the platen 101 rotates. The slurry supply 112 supplies slurry to a surface of the polishing pad 102 where it is dispensed by centrifugal forces. The slurry comprises a chemical compound reacting with the material or materials on the surface of the substrate 103. The reaction product is removed by abrasives contained in the slurry and/or the polishing pad 102. The polishing head 130, and thus the substrate 103, is rotated by the drive assembly 106 in order to substantially compensate for the effects of different angular velocities of parts of the polishing pad 102 at different radii. In advanced systems 100, the rotating polishing head 130 is additionally moved across the polishing pad 102 to further optimize the relative motion between the substrate 103 and the polishing pad 102 and to maximize pad utilization. The drive assembly 109 rotates the conditioning head 107 and thus the conditioning pad 108 attached to it. The conditioning pad 108 may comprise an abrasive component like, e.g., diamonds embedded in a matrix. Thus, the surface of the polishing pad 102 is abraded and densified slurry, as well as particles that have been polished away from the surface of the substrate, are removed from voids in the porous polishing pad 102. This process is denoted as conditioning.

Without conditioning, densified slurry and particles abraded from the substrate 103 would clog pores in the polishing pad 102. Thus, the polishing pad 102 would lose its absorbency such that most of the slurry would flow off the polishing pad 102 too quickly. Due to this degradation of the polishing pad 102, the removal rate in the polishing process would steadily decrease.

Conditioning may be performed after polishing one or more substrates 103. This, however, leads to significant variations of the removal rate due to the difference between the reworked surface of a freshly conditioned polishing pad 102 compared to the exhausted surface present immediately before the conditioning. Alternatively, the pad conditioner 131 is continuously in contact with the polishing pad 102 while the substrate 103 is polished. Thus, a more uniform rate of removal of substrate material is achieved.

Various designs of chemical mechanical polishing devices are known in the art. For example, the rotating platen 101 may be replaced with a continuous belt kept in tension by rollers moving at high speed, or slurry may be injected through the polishing pad 102 in order to deliver slurry directly to the interface between the polishing pad 102 and the substrate 103.

One problem with conventional systems for chemical mechanical polishing is that conditioning pads are consumables, which typically have lifetimes of less than 2,000 substrates. Thus, conditioning pads are expensive consumables, the price of which significantly contributes to the cost of operating a chemical mechanical polishing device.

Another problem with conventional systems for chemical mechanical polishing is that conditioning pads comprising diamonds tend to lose single diamonds, which then may cause serious scratches on the surface of the polished substrate. Depending on the type of polishing system and the control strategy thereof, a large number of substrates can be affected until the problem is either detected and removed by pad changes, or the diamond is removed by pad conditioning. This can result in high costs for scratched substrates.

In view of the above-mentioned problems, a need exists for a system for chemical mechanical polishing which comprises an improved pad conditioner.

SUMMARY OF THE INVENTION

According to one embodiment of the present invention, a system for chemical mechanical polishing comprises a polishing pad and a pad conditioner being adapted to direct a fluid jet towards the polishing pad.

According to another embodiment of the present invention, a method comprises chemical mechanical polishing using a polishing pad and directing a high pressure fluid jet towards the polishing pad to condition a surface portion of the polishing pad.

BRIEF DESCRIPTION OF THE DRAWINGS

The invention may be understood by reference to the following description taken in conjunction with the accompanying drawings, in which like reference numerals identify like elements, and in which.

Figure 1:
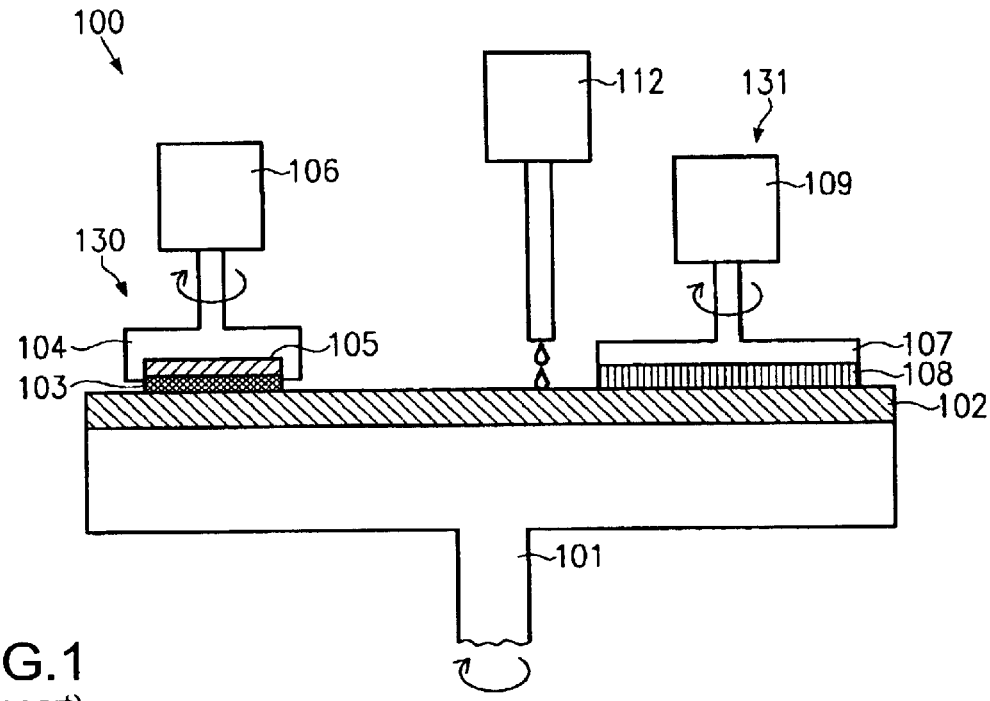
FIG.1 (prior art)
FIG. 1 shows a sketch of a conventional system for chemical mechanical polishing.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached figures. Although the various regions and structures of a semiconductor device are depicted in the drawings as having very precise, sharp configurations and profiles, those skilled in the art recognize that, in reality, these regions and structures are not as precise as indicated in the drawings. Additionally, the relative sizes of the various features and doped regions depicted in the drawings may be exaggerated or reduced as compared to the size of those features or regions on fabricated devices. Nevertheless, the attached drawings are included to describe and explain illustrative examples of the present invention. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

A system for chemical mechanical polishing according to the present invention comprises a pad conditioner which is adapted to direct one or more fluid jets towards the polishing pad. Thus, a mechanical force entry into the polishing pad is achieved which leads to the desired removal of densified slurry and particles abraded from the substrate from the polishing pad and to a recreation of absorbency of the polishing pad.

Figure 2A:
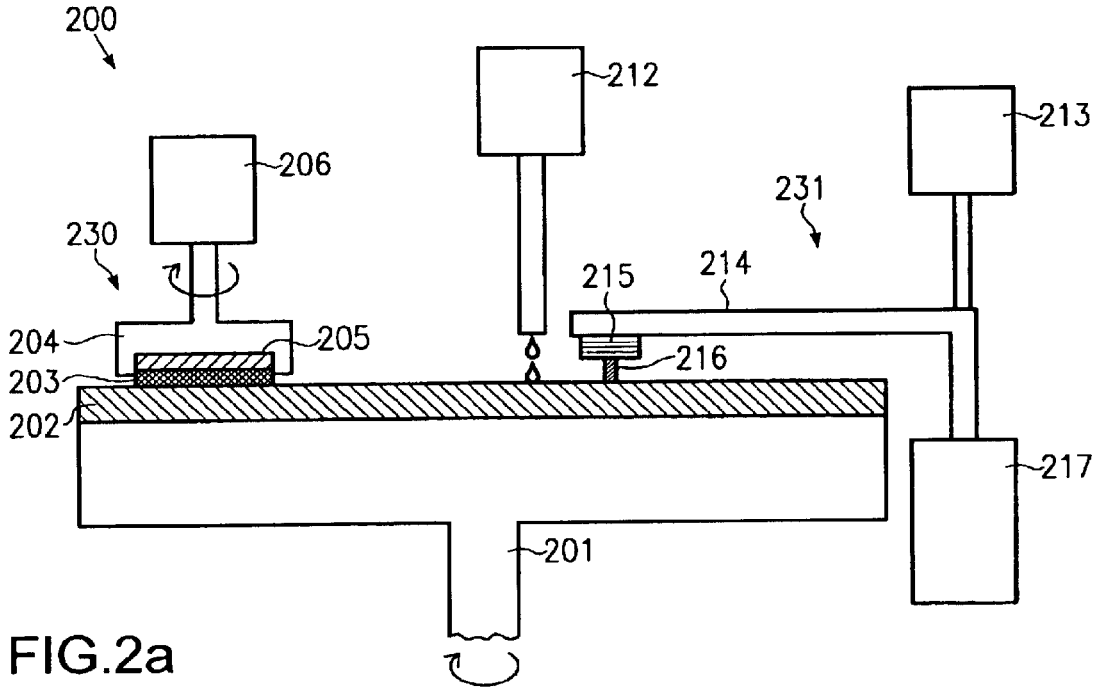
FIG. 2*a* shows a sketch of a system for chemical mechanical polishing according to an illustrative embodiment of the present invention.

FIG. 2*a* shows a schematic side view of a system 200 for chemical mechanical polishing according to an illustrative embodiment of the present invention. The system 200 comprises a platen 201, a polishing pad 202, a polishing head 230, a drive assembly 206, a slurry supply 212 and a pad conditioner 231. The polishing head 230 comprises a substrate 203, a substrate holder 205 and a body 204.

The pad conditioner 231 comprises a high pressure fluid supply 213, a movable mount 214 and a nozzle 215. The high pressure fluid supply 213 can comprise well-known means for generating fluids having high pressure, e.g., a pump or a bottle of compressed gas, and well-known means for supplying the fluid to the nozzle 215 and controlling the flow of the fluid, e.g., tubes and valves. The movable mount 214 is connected to a drive device 217, which is adapted to move the movable mount 214.

In operation, the platen 201 and the polishing head 230 rotate, and the slurry supply 212 supplies slurry to the polishing pad 202, where it is distributed by centrifugal forces. Prior to and/or during and/or after polishing a substrate, the high pressure fluid supply 213 supplies a fluid having high pressure to the nozzle 215. As the fluid passes through the nozzle 215, the pressure of the fluid decreases. Thereby, elastic energy is released and the fluid is accelerated to high velocity, and a fluid jet 216 is formed which impinges on the polishing pad 202.

Figure 2B:
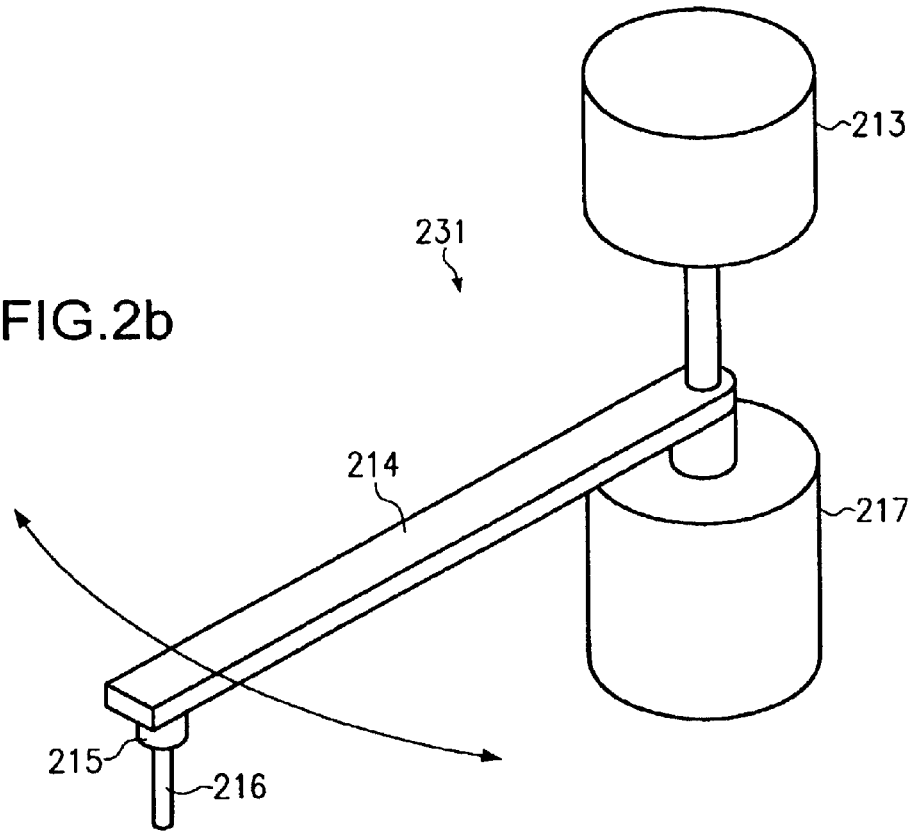
FIG. 2*b* shows a sketch of a pad conditioner in a system for chemical mechanical polishing according to another illustrative embodiment of the present invention.

FIG. 2*b* shows a schematic perspective view of the pad conditioner 231. For the sake of convenience, like reference numerals have been used in FIGS. 2*a* and 2*b*. The fluid jet 216 may impinge at an approximately perpendicular angle to the polishing pad 202. In other embodiments of the present invention, the fluid jet 216 impinges at an incline to the polishing pad 202. As the fluid jet 216 impinges on the polishing pad 202, the fluid is decelerated and exhibits force to an area on the polishing pad 202 such that densified slurry and particles abraded from the substrate 203 are removed from voids in the porous pad material. A fluid jet 216 having a high velocity may also abrade the pad material itself.

In one illustrative embodiment, the fluid jet 216 can have a substantially cylindrical shape. It can have a diameter that is small compared to the radius of the polishing pad 202. Of course, other shapes or configurations are possible for the fluid jet 216.

The pad conditioner 231 comprises a drive device 217 being connected to the mobile mount 214, which can rotate the mobile mount 214 around an axis substantially perpendicular to the surface of the polishing pad 202. Thus, the nozzle 215 and the fluid jet 216 move within a plane that is substantially parallel to the polishing pad surface, ensuring a constant distance between the nozzle 215 and the polishing pad 202.

In one illustrative embodiment of the present invention, the drive device 217 comprises a servo motor that is controlled by a microprocessor in coordination with the rotation of the platen 201.

The drive device 217 is adapted to change the direction of rotation of the mobile mount 214 as the fluid jet 216 approaches the edge of the polishing pad 202 in order to ensure that the fluid jet 216 impinges on the polishing pad 202. Thus, the fluid jet 216 oscillates in a bi-directional circular motion over the polishing pad 202.

Moving the fluid jet 216 over the rotating polishing pad 202 allows a substantially uniform conditioning of the surface of the polishing pad 202 with a fluid jet 216 having a diameter which is small compared to the radius of the polishing pad 202 if the rotational frequency of the platen 201 and the frequency of the oscillating motion of the fluid jet 216 are coordinated. The motion of the fluid jet 216 relative to the polishing pad 202 may be advantageously controlled so as to avoid parts of the polishing pad 202 from being frequently exposed to the fluid jet 216 while other parts of the polishing pad 202 are rarely or never exposed to the fluid jet 216. In one embodiment, this can be achieved if the motion of the fluid jet 216 is controlled to be slow enough such that the fluid jet 216 moves over a distance equal to or less than the diameter of the fluid jet 216 during one revolution of the platen 201.

In other embodiments of the present invention, the ratio between the frequency of the oscillating motion of the fluid jet 216 and the rotational frequency of the platen 201 is a fraction a/b of integers a, b, where a is not an integer multiple of b. Then, the motion of the fluid jet 216 relative to the polishing pad 202 repeats after b revolutions of the platen 201. In one particular embodiment, b is equal to or greater than the ratio between the radius of the polishing pad 202 and the diameter of the fluid jet 216.

The angular velocity of the circular motion of the fluid jet 216 need not be constant. It may be desirable to move the fluid jet 216 faster if it impinges on a point close to the center of the polishing pad 202 and slower if it impinges on a point closer to the perimeter of the polishing pad 202. Thus, a more uniform exposure of the surface of the polishing pad 202 to the fluid jet 216 is obtained.

In other embodiments of the present invention, the mobile mount 214 performs a unidirectional circular motion over the polishing pad 202. The drive device may be provided over the surface of the polishing pad 202, similar to the drive assembly 109 shown in FIG. 1, and the dimensions of the mobile mount 214 are such that the fluid jet 216 always impinges on the polishing pad 202 as the mobile mount 214 performs a complete revolution.

If desired, conditioning of the polishing pad 202 can be performed continuously or intermittently while a substrate 203 is polished. To this end, in one embodiment, the high pressure fluid supply 213 is configured to supply one or more high pressure gas streams as the fluid jet 216. With this configuration, dilation and/or a chemical change of the slurry may be substantially avoided. Appropriate gases may include, without limiting the present invention air, nitrogen, carbon dioxide or a noble gas. Alternatively, polishing and conditioning can be performed successively. For example, conditioning can be performed after one or more substrates have been polished.

The fluid jet 216 can comprise water, for example, provided as ultra pure water. In other embodiments of the present invention, the fluid jet 216 may comprise another liquid, e.g., an organic solvent. The fluid jet 216 may also comprise a mixture of a liquid and a gas. The fluid jet 216 may also comprise abrasive particles which abrade the surface of the polishing pad 202. Conditioning with a fluid jet 216 comprising abrasive particles and polishing of the substrate 203 may be performed successively to prevent the substrate 203 from being scratched by abrasive particles remaining on the polishing pad.

The high pressure fluid supply can be adapted to supply different fluids to the nozzle 215. In one embodiment of the present invention, the polishing pad 202 is conditioned by a fluid jet which consists of pure water while a substrate 203 is polished. After the polishing of one or more substrates, conditioning with a fluid jet 216 comprising abrasive particles is performed.

Figure 3:
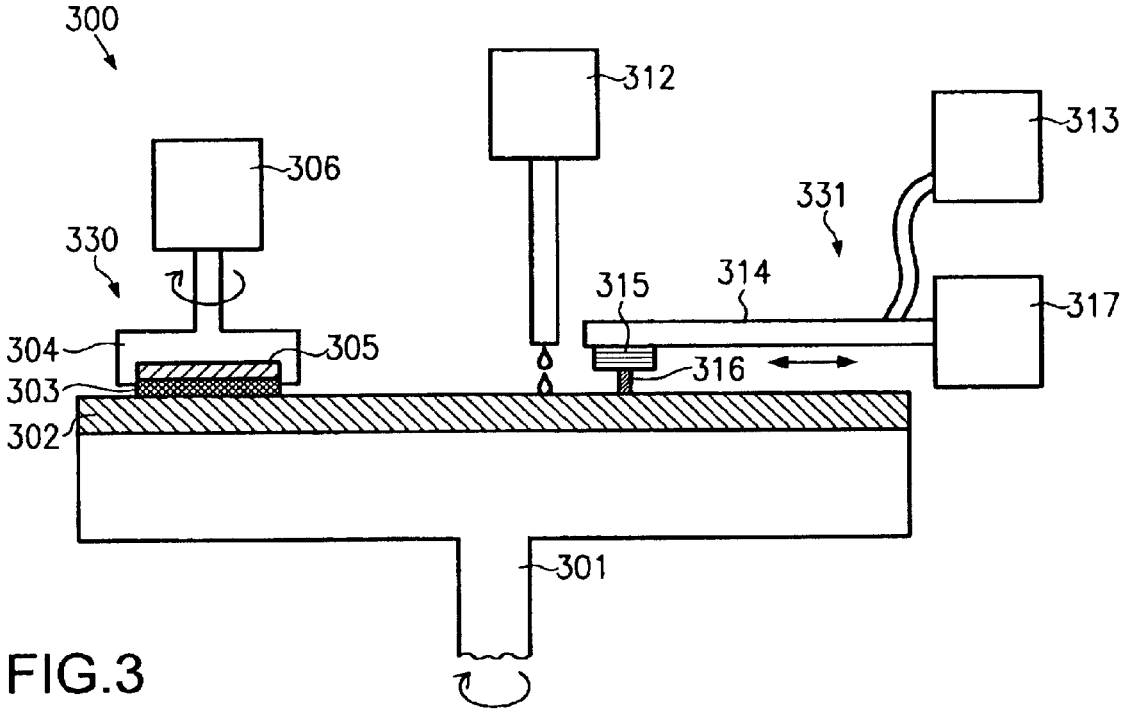
FIG. 3 shows a sketch of a system for chemical mechanical polishing according to yet another illustrative embodiment of the present invention.

FIG. 3 shows a schematic side view of a system 300 for chemical mechanical polishing according to another embodiment of the present invention. The system 300 comprises a platen 301, a polishing pad 302, a polishing head 330, a drive assembly 306, a slurry supply 312 and a pad conditioner 331. The polishing head 330 comprises a substrate 303, a substrate holder 305 and a body 304.

The pad conditioner 331 contains a high pressure fluid supply 313, a mobile mount 314, a nozzle 315 and a drive device 317. The high pressure fluid supply 313 is configured to supply a fluid having high pressure to the nozzle 315 to form a fluid jet 316. The drive device 317 is adapted to move the mobile mount 314 back and forth in a radial direction of the platen 301.

In operation, the fluid jet 316 oscillates in a bi-directional linear motion over the polishing pad 302. Similar to the embodiment of the present invention described with reference to FIGS. 2*a* and 2*b*, the frequency of the oscillation of the fluid jet 316 and the rotational frequency of the platen 301 are coordinated such that a substantially uniform conditioning of the surface of the polishing pad 302 is achieved.

Advantageously, the pad conditioner 331, with the fluid jet 316 performing a linear motion, requires a smaller amount of free space above the polishing pad 302 than, for example, the pad conditioner 231 where the fluid jet 216 performs a circular motion.

Figure 4:
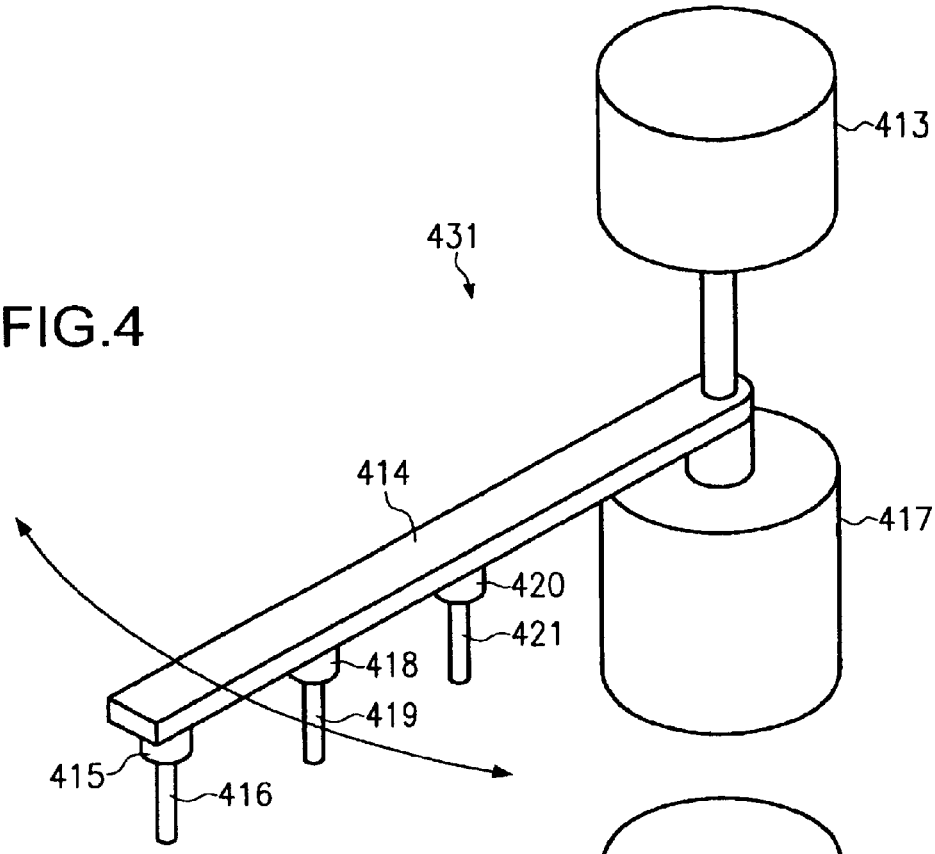
FIG. 4 shows a sketch of a pad conditioner in a system for chemical mechanical polishing according to yet another illustrative embodiment of the present invention.

FIG. 4 shows a schematic perspective view of a pad conditioner 431 in a system for chemical mechanical polishing according to yet another illustrative embodiment of the present invention. The pad conditioner 431 comprises a high pressure fluid supply 413, a mobile mount 414 and a drive device 417. A plurality of nozzles 415, 418, 420 is attached to the mobile mount 414. In operation, a fluid flows through the nozzles 415, 418, 420 such that a plurality of fluid jets 416, 419, 421 is formed. These fluid jets 416, 419, 421 are directed to a polishing pad (not shown). The drive device 417 is adapted to rotate the mobile mount 414 around an axis substantially perpendicular to a surface of the polishing pad such that the fluid jets 416, 419, 421 and the nozzles 415, 418, 420 perform a bi-directional circular motion within a plane essentially parallel to the polishing pad surface. The direction of the fluid jets 416, 419, 421 can be perpendicular to this plane.

An advantage of a pad conditioner 431 that is adapted to direct a plurality of fluid jets 416, 419, 421 to the polishing pad is that it is sufficient to pivot the mobile mount 414 by a smaller angle to condition the whole surface of the polishing pad compared to a pad conditioner with only one fluid jet. Thus, the pad conditioner 431 requires a smaller amount of free space above the polishing pad. A further advantage of the pad conditioner 431 described with reference to FIG. 4 is that the force entry into the polishing pad is more evenly distributed over the area of the polishing pad.

In a further embodiment, the drive device 417 is adapted to move the mobile mount 414 in a bi-directional linear motion similar to the embodiment described with reference to FIG. 3.

In other embodiments of the present invention, the system for chemical mechanical polishing 400 may comprise a plurality of nozzles that are attached to a plurality of mobile mounts that can be moved independently by a plurality of drive devices (not shown) to produce the plurality of fluid jets.

Figure 5:
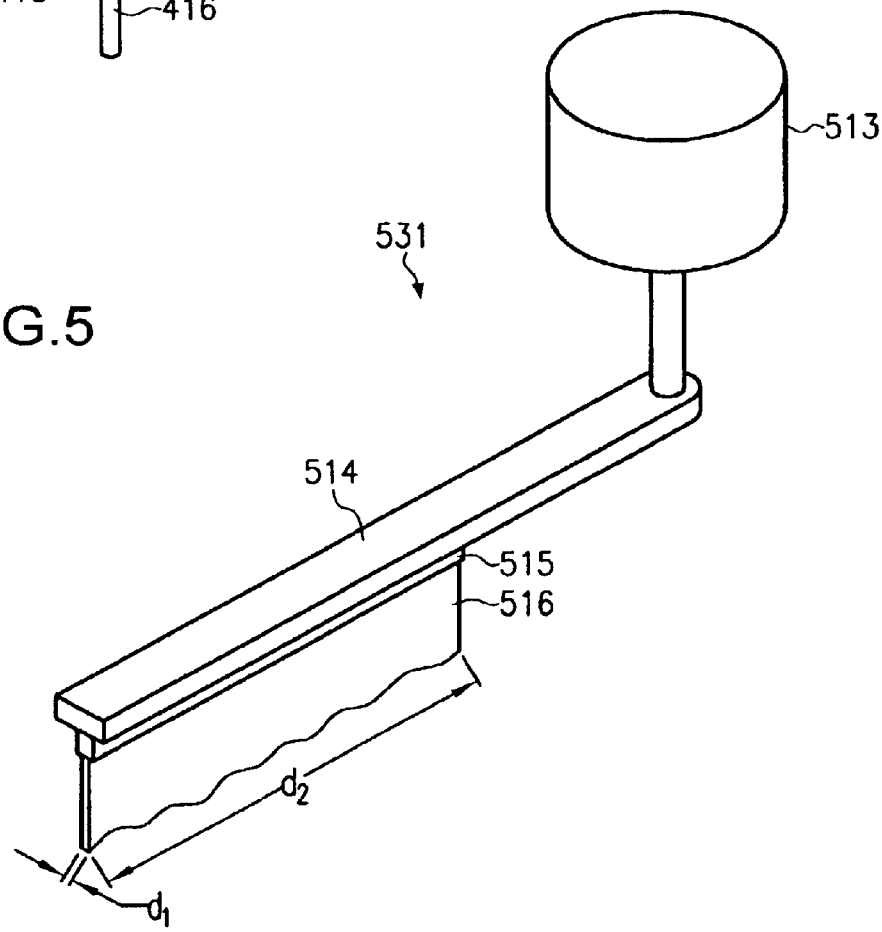
FIG. 5 shows a sketch of a pad conditioner in a system for chemical mechanical polishing according to yet another illustrative embodiment of the present invention.

FIG. 5 shows a pad conditioner 531 in a system for chemical mechanical polishing according to further embodiments of the present invention. The pad conditioner 531 comprises a nozzle 515 being attached to a mount 514. In operation, a high pressure fluid supply 513 supplies fluid at high pressure to the nozzle 515. An opening of the nozzle 515 has an elongated shape, such that it emits a line-shaped fluid jet 516. The shape of the fluid jet 516 can be characterized by a first diameter $d_1$ in a cross-direction and a second diameter $d_2$ in a lengthwise direction, wherein $d_2>d_1$. In one embodiment, $d_2$ is equal to the radius of the polishing pad used. Then, the whole surface of the rotating polishing pad can be conditioned without moving the fluid jet 516. Thus, the number of moving parts may be reduced.

Figure 6:
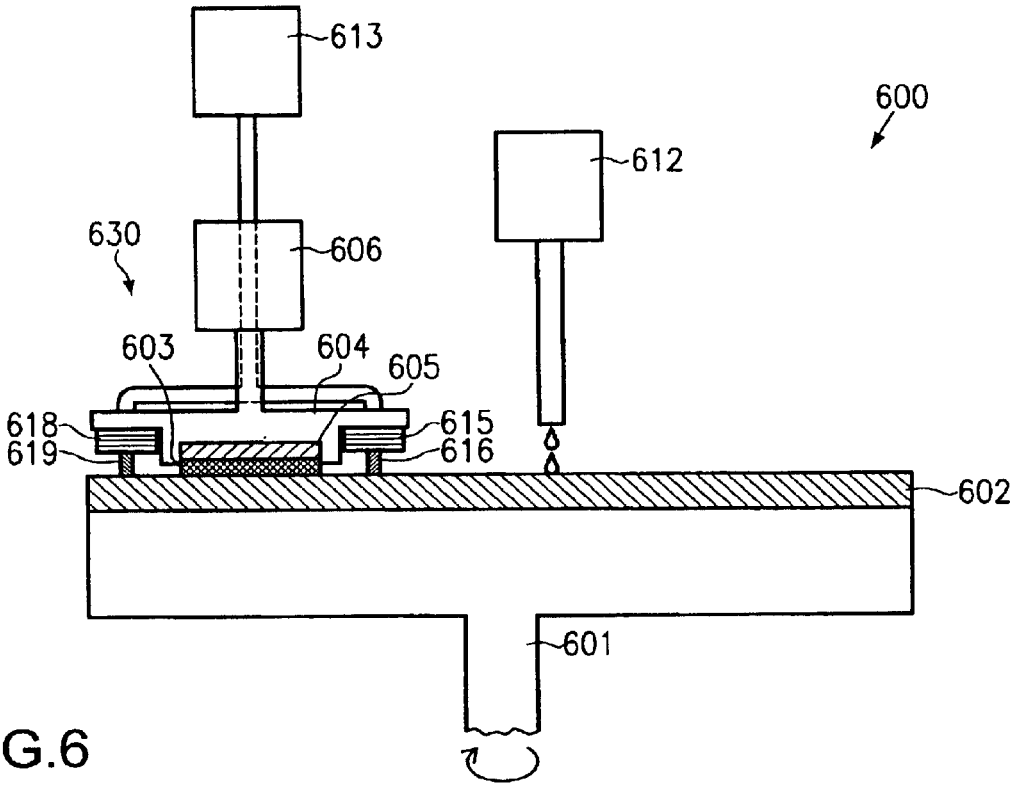
FIG. 6 shows a sketch of a system for chemical mechanical polishing according to yet another illustrative embodiment of the present invention.

A further embodiment of the present invention is described with reference to FIG. 6. A system 600 for chemical mechanical polishing comprises a polishing pad 602 being attached to a platen 601 which rotates during operation. The system 600 further comprises a slurry supply 612 and a polishing head 630 comprising a substrate 603, a substrate holder 605 and a body 604. A drive assembly 606 rotates the polishing head 630 during operation of the system 600. A plurality of nozzles 615, 618 are attached to the polishing head 630. A high pressure fluid supply 613 supplies fluid at high pressure to the nozzles 615, 618 such that fluid jets 616, 619 are created that are directed to the surface of the polishing pad 602. The high pressure fluid supply 613 and the nozzles 615, 618 together form a pad conditioner, which is attached to the polishing head 630.

The fluid jets 616, 619 are moved over the surface of the polishing pads 602, as the polishing head 630 and the platen 601 rotate. In this embodiment, the rotation of the polishing head 630 is advantageously employed for the motion of the fluid jets 616, 619, such that no additional drive device is required for the pad conditioner. A further advantage of this embodiment is that the surface of the polishing pad is conditioned directly before it encounters the substrate 603, such that it is ensured that a freshly conditioned polishing pad surface is used for polishing the substrate 603. In one embodiment, the rotational frequency of the platen 601 and the polishing head 630 are coordinated to ensure a substantially uniform conditioning of the polishing pad 602.

Figure 7:
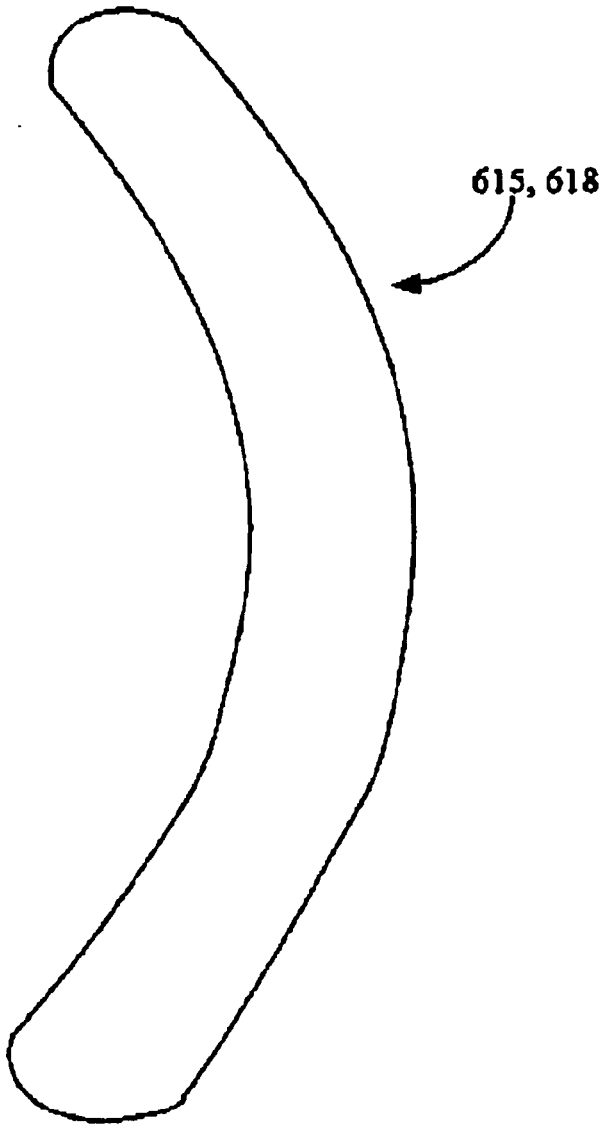
FIG. 7 illustrates one embodiment of an arcuate shape nozzle.

In other embodiments of the present invention, the nozzles 615, 618 are arranged around the polishing head 630 so as to form a substantially ring-shaped nozzle assembly. In a further embodiment, one or more of the nozzles 615, 618 may have an arcuate shape (as illustrated in FIG. 7) to provide an arcuate line-shaped fluid jet, or, in still a further embodiment, the plurality of arcuated nozzles may be replaced by a single substantially ring-shaped nozzle. In operation, fluid at high pressure is supplied to the nozzles 615, 618 such that a fluid jet around the polishing head is created.

In the embodiments described above, it may be advantageous to use a fluid that substantially maintains the chemistry of the slurry, i.e., the fluid may be a gas, or a chemical reagent may be supplied along with the fluid jet.

In a system for chemical mechanical polishing according to the present invention, the pressure of the fluid being supplied to a nozzle, the size of an opening of the nozzle and the angle at which a fluid jet impinges on the polishing pad can be adapted to the individual application and the used pad material. In a pad conditioner comprising a plurality of nozzles, the individual nozzles may have different diameters, and the individual fluid jets may impinge on the surface of the polishing pad at different angles. The individual fluid jets may comprise different fluids.

A jet moving unit for moving one or more fluid jets over the surface of a polishing pad need not comprise a mobile mount as in the embodiments described above. In other embodiments of the present invention, the position at which a fluid jet impinges on the polishing pad may be controlled by changing a direction of the fluid jet by pivoting a fixed nozzle.

In further embodiments of the present invention, one or more pivoting nozzles are attached to a mobile mount which may be coupled to a drive device. Thus, both the angle at which the one or more fluid jets emitted by the nozzle or nozzles impinges on the polishing pad and the position where it impinges can be varied.

The present invention is not limited to systems for chemical mechanical polishing comprising a rotating platen and a slurry supply as shown in FIGS. 1, 2*a*, 3 and 6. Pad conditioners that are adapted to direct a fluid jet to the surface of a polishing pad may also be used in a sequential linear polisher, which comprises a polishing pad being attached to a continuous belt kept in tension by rollers, wherein this belt moves at high speed. Slurry may also be supplied directly to the interface between a polishing pad and a polished substrate by injecting it through the polishing pad instead of using a slurry supply above the polishing pad as shown in FIGS. 1, 2*a*, 3 and 6.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A system for chemical mechanical polishing, comprising:

a polishing pad; and a pad conditioner comprising at least one nozzle having an elongated-shaped opening that is adapted to direct a line-shaped fluid jet towards said polishing pad wherein a direction of said fluid jet is substantially perpendicularly to a plane substantially parallel to a surface of said polishing pad.

2. The system of claim 1, wherein said pad conditioner comprises:

a high pressure fluid supply; and said nozzle is connected to said high pressure fluid supply to supply said line-shaped fluid jet.

3. The system of claim 1, wherein a first dimension of said line-shaped fluid jet is substantially equal to a radius of said polishing pad.

4. The system of claim 1, wherein said fluid jet comprises a liquid.

5. The system of claim 1, wherein said fluid jet comprises water.

6. The system of claim 1, wherein said fluid jet comprises a gas.

7. The system of claim 1, wherein said fluid jet comprises abrasive particles.

8. The system of claim 1, further comprising a jet moving unit being adapted to move said fluid jet.

9. The system of claim 8, wherein said jet moving unit is adapted to move said fluid jet in an oscillating motion.

10. The system of claim 9, wherein said jet moving unit is configured to provide said oscillating motion as a bi-directional circular motion.

11. The system of claim 9, wherein said jet moving unit is configured to provide said oscillating motion as a bi-directional linear motion.

12. The system of claim 8, wherein said jet moving unit is adapted to move said fluid jet in said plane to a surface of said polishing pad.

13. The system of claim 8, wherein said jet moving unit is adapted to move said fluid jet in a unidirectional circular motion.

14. The system of claim 8, wherein said pad conditioner comprises a high pressure fluid supply and said nozzle is connected to said high pressure fluid supply to supply said fluid jet, and wherein said jet moving unit comprises a mobile mount, said nozzle being attached to said mobile mount.

15. The system of claim 14, wherein said jet moving unit further comprises a drive device being adapted to move said mobile mount.

16. The system of claim 1, further comprising a slurry supply being adapted to supply slurry to said polishing pad.

17. The system of claim 1, wherein said pad conditioner comprises a single nozzle having an elongated-shaped opening that is adapted to direct said line-shaped fluid jet toward said polishing pad.

18. A method, comprising:

chemically mechanically polishing a substrate on a polishing pad; and supplying a high pressure fluid to a nozzle having an elongated-shaped opening to thereby direct a high pressure line-shaped fluid jet from said nozzle towards said polishing pad to condition a surface portion of said polishing pad wherein a direction of said fluid jet is substantially perpendicularly to a plane substantially parallel to a surface of said polishing pad.

19. The method of claim 18, wherein said chemical mechanical polishing and said directing said fluid jet towards said polishing pad are performed simultaneously.

20. The method of claim 18, wherein said chemical mechanical polishing and said directing said fluid jet towards said polishing pad are performed successively.

21. The method of claim 18, wherein said line-shaped fluid jet has a first dimension that is substantially equal to a radius of said polishing pad.

22. The method of claim 18, wherein said fluid jet comprises a liquid.

23. The method of claim 18, wherein said fluid jet comprises water.

24. The method of claim 18, wherein said fluid jet comprises a gas.

25. The method of claim 18, wherein said fluid jet comprises abrasive particles.

26. The method of claim 18, further comprising moving said fluid jet in an oscillating motion.

27. The method of claim 26, wherein said oscillating motion comprises a bi-directional circular motion.

28. The method of claim 26, wherein said oscillating motion comprises a bi-directional linear motion.

29. The method of claim 18, further comprising moving said fluid jet in said plane to a surface of said polishing pad.

30. The method of claim 18, further comprising moving said fluid jet in a unidirectional circular motion.

31. The method of claim 18, further comprising supplying slurry to said polishing pad.

32. The method of claim 18, further comprising moving said fluid jet and said polishing pad, said moving said fluid jet and said moving said polishing pad being coordinated.

33. A system for chemical mechanical polishing, comprising:

a polishing pad;

a polishing head; and at least one nozzle having arcuate shaped opening, coupled to said polishing head, said nozzle being adapted to direct a fluid jet toward said polishing pad to condition said polishing pad.

34. The system of claim 33, further comprising a high pressure fluid system adapted to supply a high pressure fluid to said at least one nozzles having arcuate shape opening.

35. The system of claim 33, wherein said at least one nozzle comprises a plurality of nozzles coupled to said polishing head wherein each of said nozzles is adapted to direct a fluid jet toward said polishing pad.

36. The system of claim 33, wherein said system is adapted to direct said fluid jet toward said polishing pad while a substrate is being polished in said system.

37. The system of claim 33, wherein said system is adapted to direct said fluid jet toward said polishing pad while a substrate is not being polished in said system.

38. A method, comprising:

providing a polishing head having at least one nozzle coupled thereto; and supplying a high pressure pad conditioning fluid to said at least one nozzle to direct a fluid jet toward a polishing pad to thereby condition said polishing pad.

39. The method of claim 38, further comprising:

positioning a substrate in said polishing head; and polishing said substrate by urging said substrate into contact with said polishing pad and providing relative movement between said polishing pad and said substrate.

40. The method of claim 38, wherein said act of supplying said high pressure fluid to said at least one nozzle is performed while a substrate is being polished.

41. The method of claim 38, wherein said act of supplying said high pressure fluid to said at least one nozzle is performed while a substrate is not being polished.

42. The method of claim 38, wherein supplying a high pressure fluid to at least one nozzle comprises supplying a high pressure fluid to a plurality of nozzles coupled to said polishing head, wherein each of said nozzles is adapted to direct a fluid jet toward said polishing pad.

* * * * *